US009848661B2

(12) United States Patent
Harris et al.

(10) Patent No.: US 9,848,661 B2
(45) Date of Patent: Dec. 26, 2017

(54) METHOD AND AN APPARATUS FOR ATTACHING HAIR EXTENSIONS TO HUMAN HAIR

(71) Applicant: HARRIS WEBB, LLC, Oakland, CA (US)

(72) Inventors: Jessica Harris, Los Banos, CA (US); Dorian Webb, Oakland, CA (US)

(73) Assignee: HARRIS WEBB, LLC, Oakland, CA (US)

( * ) Notice: Subject to any disclaimer, the term of this patent is extended or adjusted under 35 U.S.C. 154(b) by 0 days.

(21) Appl. No.: 14/333,256

(22) Filed: Jul. 16, 2014

(65) Prior Publication Data

US 2015/0313303 A1 Nov. 5, 2015

Related U.S. Application Data

(60) Provisional application No. 61/847,330, filed on Jul. 17, 2013.

(51) Int. Cl.
*A41G 3/00* (2006.01)
*A41G 5/00* (2006.01)

(52) U.S. Cl.
CPC ..... *A41G 5/0086* (2013.01); *A41G 5/0066* (2013.01); *A41G 5/0073* (2013.01)

(58) Field of Classification Search
CPC .. A41G 3/0008; A41G 3/0033; A41G 5/0026; A41G 5/0053; A41G 5/0066; A41G 5/0073; A41G 5/0086; A61B 17/068; B25C 5/00; B25C 5/02; B25C 5/0285
USPC ..... 132/201, 200, 212, 217, 223, 236–238, 132/240–243, 53–56; 29/525.05, 525.01, 29/788; 606/116, 139, 142, 143, 187, 606/117; 24/67 P; 227/175.1, 901, 902, 227/132, 151, 155; 54/1, 78; 72/409.05
See application file for complete search history.

(56) References Cited

U.S. PATENT DOCUMENTS

| | | | | | |
|---|---|---|---|---|---|
| 4,372,316 | A | * | 2/1983 | Blake et al. | 606/143 |
| 4,915,100 | A | * | 4/1990 | Green | 227/176.1 |
| 5,004,142 | A | * | 4/1991 | Olesen | 227/155 |
| 5,516,025 | A | * | 5/1996 | Eriksson | 227/155 |
| 5,769,100 | A | * | 6/1998 | Alexander | 132/271 |
| 5,894,846 | A | * | 4/1999 | Gang | 132/201 |
| 6,135,124 | A | * | 10/2000 | Grant | 132/271 |

(Continued)

*Primary Examiner* — Rachel Steitz
(74) *Attorney, Agent, or Firm* — Morgan, Lewis & Bockius LLP

(57) ABSTRACT

A method is provided for attaching a hair extension to a recipient's hair. The method comprises defining an anchoring structure for receiving attachment of the hair extension; positioning the hair extension adjacent to the anchoring structure; employing a hair extension attachment apparatus to attach the hair extension to the anchoring structure; wherein the employment includes manipulating a user manipulable hand member of the apparatus to position a shield mechanism between the recipient's scalp and the fastener as the fastener is being crimped; and to crimp a fastener to attach the hair extension to the anchoring structure. An apparatus is provided for attaching a hair extension to the recipient's hair. The apparatus comprises a mechanism for crimping a fastener to attach the hair extension; and a shield mechanism for preventing the fastener from contacting the recipient's scalp as the fastener is being crimped.

6 Claims, 9 Drawing Sheets

(56) References Cited

U.S. PATENT DOCUMENTS

| | | | | |
|---|---|---|---|---|
| 6,279,303 | B2 * | 8/2001 | Sloan | 54/1 |
| D507,849 | S * | 7/2005 | Lee | D28/10 |
| D542,970 | S * | 5/2007 | Park | D28/10 |
| 7,621,433 | B2 * | 11/2009 | Ivarsson | 227/155 |
| 2004/0011372 | A1 * | 1/2004 | Park | 132/201 |
| 2005/0247326 | A1 * | 11/2005 | Park | 132/201 |
| 2007/0261708 | A1 * | 11/2007 | Makino et al. | 132/201 |
| 2013/0048006 | A1 * | 2/2013 | Springfield-Thomas | A41G 5/006 132/201 |

* cited by examiner

METHOD AND AN APPARATUS FOR ATTACHING HAIR EXTENSIONS TO HUMAN HAIR

CROSS-REFERENCE TO RELATED APPLICATION

The present application claims priority to U.S. provisional patent application Ser. No. 61/847,330, filed on Jul. 17, 2013.

TECHNICAL FIELD

Embodiments of the disclosure relate generally to the field of personal grooming, for instance, to attaching hair extensions to human hair. Embodiments relate more particularly to the use of a crimping and fastening mechanism for ensuring a quick, safe and painless method of attaching hair extensions.

BACKGROUND

As beauty consciousness grows among people of all ages, an increasing number of men and women feel the need to look their best at all times. Hair styles serve as important part of a persona, because they are simultaneously public (visible to everyone), personal (biologically linked to the body) and highly malleable to suit cultural and personal preferences.

One way of enhancing the look of a particular hairstyle is by using hair extensions. Hair extensions, also known as "weft hair extensions", add length and/or fullness of volume to human hair. These extensions are a means to lengthen one's hair by incorporating artificial hair or natural hair, collected from other individuals, to one's own. There are many reasons men and women wear extensions. Sometimes, people desire longer hair or a greater volume of hair than they naturally have. Others gradually go bald, or have receding hair lines. A person of either gender might cut their hair and regret it later on. Some people have a hard time growing their hair once it reaches a certain length. Hair extensions help them reach their desired length. Some people who do not want to damage their own natural hair by dyeing it use hair extensions to add streaks of color throughout their hair.

Current methods for temporary hair augmentation include sew-ins, gluing, hair fusion, hair tape, metal coils, rubber bands and hair clips. Each of these methods has substantial drawbacks, however. Attaching hair extensions using the sew-in method is a painful and painstaking process that involves a needle and thread to join hair extensions to the client's natural hair. Often, the needle pricks the scalp during the process of hair extension. Gluing and hair fusion are also time consuming processes that involve attaching small groups of hair to the client's own with a fixative. Due to the nature of the fixative, both types of these hair augmentation processes often entail some loss of the client's natural hair during their removal. Hair tape is a fairly quick method of hair augmentation, but is not a reliable one as hair extensions attached to the client's natural hair in this manner may not attach securely if the client's hair is oily, and may cause hair loss when removing if the client's hair is dry. Metal coils and rubber bands are other time consuming hair augmentation methods that involve the addition of small quantities of hair to even smaller clusters of the client's own hair. Both methods involve pulling of the client's natural hair at its roots, and often create hair loss with their removal. Hair clips are a quick method of hair extension that are simple enough for the client to attach herself. Hair clips can be worn during the day, but are removed prior to going to bed as they are uncomfortable to sleep in.

There is a need for a method for attaching hair extensions quickly and easily with the minimum of discomfort that also allows for their painless and easy removal and/or repositioning. There is a need for a suitable apparatus which, when used by a hair stylist on a hair extension client, facilitates the attachment of the hair extensions.

SUMMARY

A method is provided for attaching a hair extension to a recipient's hair. The method comprises defining an anchoring structure for receiving attachment of the hair extension; positioning the hair extension adjacent to the anchoring structure; employing a hair extension attachment apparatus to attach the hair extension to the anchoring structure; wherein the employment includes manipulating a user manipulable hand member of the apparatus to position a shield mechanism between the recipient's scalp and the fastener as the fastener is being crimped; and to crimp a fastener to attach the hair extension to the anchoring structure. An apparatus is provided for attaching a hair extension to the recipient's hair. The apparatus comprises a mechanism for crimping a fastener to attach the hair extension; and a shield mechanism for preventing the fastener from contacting the recipient's scalp as the fastener is being crimped.

BRIEF DESCRIPTION OF THE VIEWS OF DRAWINGS

In the accompanying figures, similar reference numerals may refer to identical or functionally similar elements. These reference numerals are used in the detailed description to illustrate various embodiments and to explain various aspects and advantages of the present disclosure.

Figure 6A:
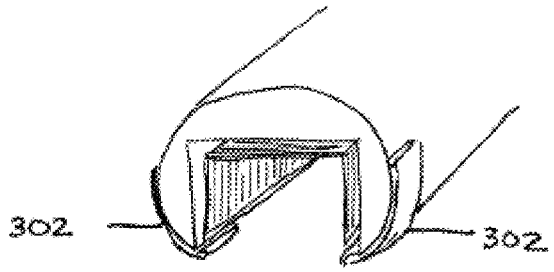
FIGS. 6A, 6B, 6C and 6D are close-up, section views of stages of operation of the hand held apparatus of FIGS. 3 and 4, during the process of using the hand held device to attach a hair extension.
Figure 6B:
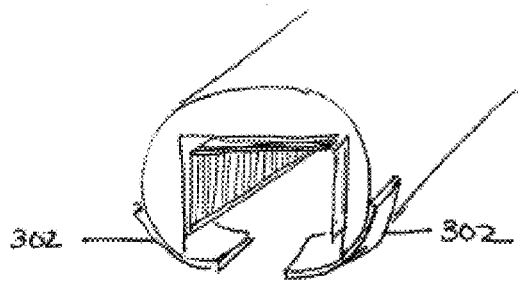
Figure 6C:
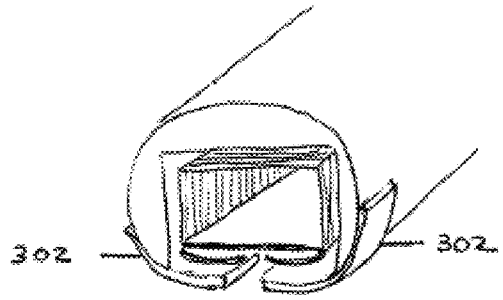
Figure 7A:
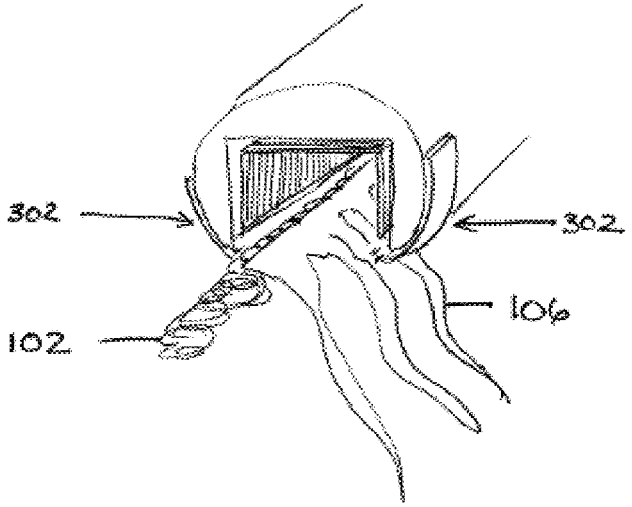
Figure 7B:
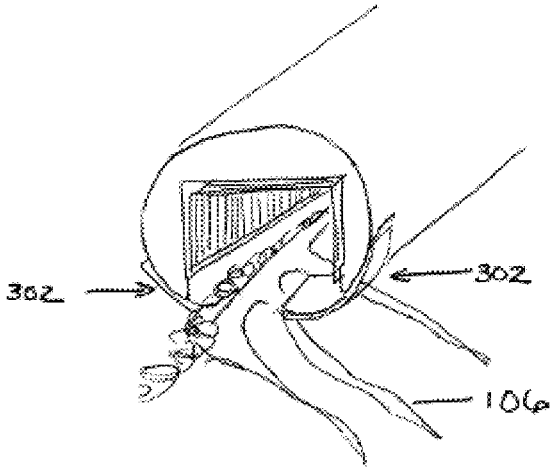
Figure 7C:
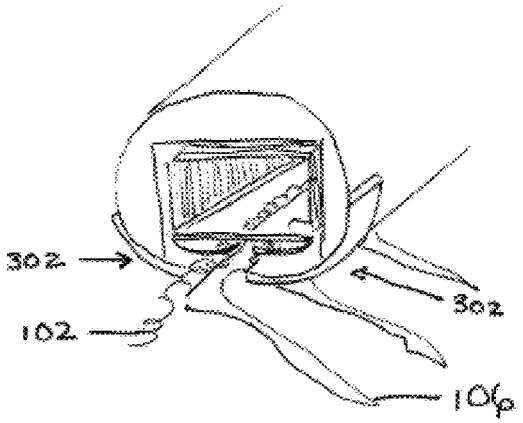

FIGS. 7A, 7B, and 7C depict operation of a hair extension attachment method, similar to those of FIGS. 6A through 6C, but further showing the person's hair and the hair attachment in their respective positions;

FIGS. 8A-1, 8A-2, 8A-3, 8B-1, 8B-2, 8B-3, 8C-1, 8C-2, 8C-3, 8D-1, 8D-2, and 8D-3 are views of a hair extension attachment device according to an embodiment, showing stages of its operation;

FIGS. 9A-1, 9A-2, 9A-3, 9B-1, 9B-2, 9B-3, 9C-1, 9C-2, 9C-3, 9D-1, 9D-2, and 9D-3 are views of a hair extension attachment device with a fixed shield according to another embodiment, showing stages of its operation; and FIGS. 10A-1, 10A-2, 10A-3, 10B-1, 10B-2, 10B-3, 10C-1, 10C-2, 10C-3, 10D-1, 10D-2, and 10D-3 are views of a hair extension attachment device with a retractable shield according to yet another embodiment, showing stages of its operation.

DETAILED DESCRIPTION OF THE EMBODIMENTS

The above-mentioned needs are met by a method and apparatus using an apparatus, such as a hand held apparatus, to attach one or more wefts of hair extensions to a recipient's hair. The fastener apparatus may, for instance, be similar to a surgical stapler, or other type of stapler, and may operate somewhat analogously to conventional surgical staplers. The following detailed description is intended to provide example implementations to one of ordinary skill in the art, and is not intended to limit the invention to the explicit disclosure, as one of ordinary skill in the art will understand that variations can be substituted that are within the scope of the invention as described.

Figure 1:
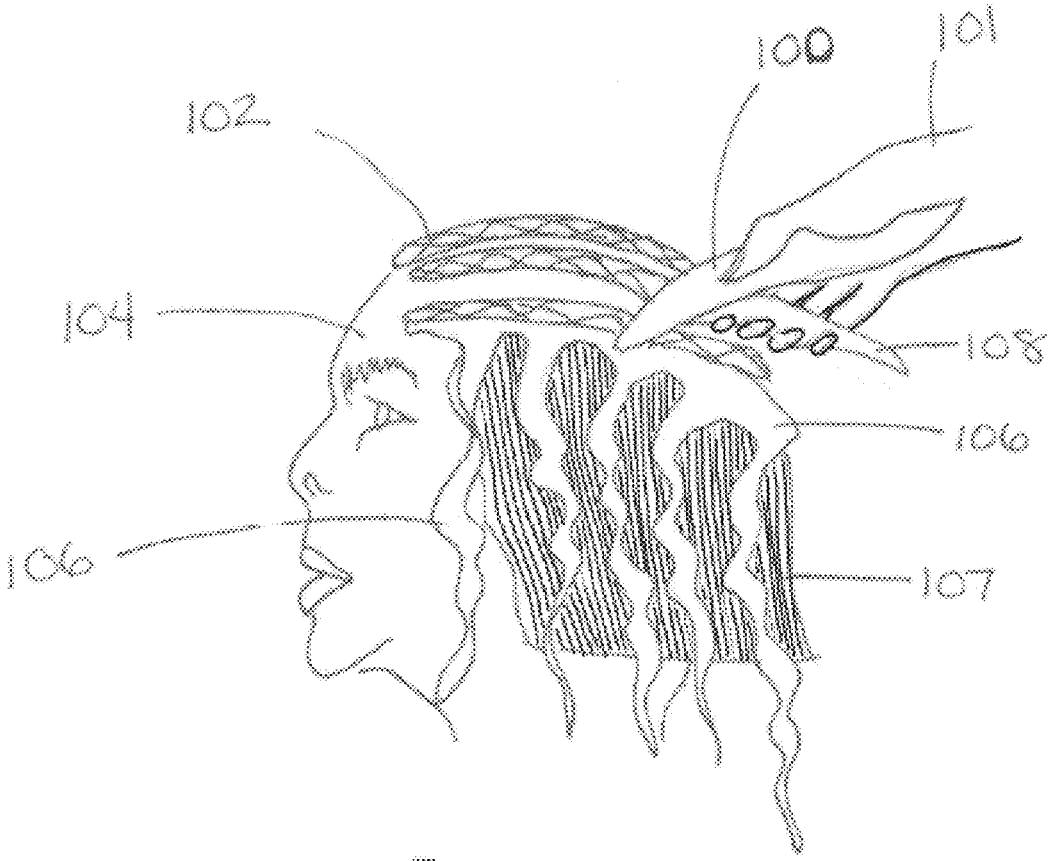
FIG. 1 is an exemplary view of a recipient receiving a hair extension, according to the embodiments as disclosed herein.

FIG. 1 is an exemplary view of a person 104, also referred to herein as a "recipient" or "client," having a hair extension 106 applied to the recipient 104's hair, according to the embodiments as disclosed herein. As depicted in FIG. 1, a hand held device 100 (described in detail below) is used by a hair stylist, hair salon employee or other applying person 101, to attach hair extensions 106 to a recipient's hair. It is, of course, possible that the hair stylist 101 attaching the hair extension, and the person 104 receiving the hair extension, are the same person; in other words, that the recipient 104 is applying the hair extensions to herself.

The hair 107 of the recipient 104 is prepared for the attachment of the hair extension 106, for instance, by braiding into cornrows along the scalp of the person 104, to serve as a hair extension anchoring structure 102. In a preferred embodiment, a hair stylist 101 who wishes to integrate the weft hair extension 106 into a client 104's hair begins by producing an anchoring structure 102 from the client 104's hair. This is done by plaiting a tract of natural hair in one or more cornrows on the recipient's scalp. Cornrowing is a type of hair grooming where the hair is braided very close to the scalp, using an underhand, upward motion to produce a continuous, raised row.

The handheld device 100 is then employed to integrate one or more weft hair extensions 106 into each distinct tract of natural hair making up the anchoring structure 102. A hair mesh worn by the recipient 104, may alternatively be used as the anchoring structure when placed atop the recipient's natural hair. A wig or wig cap worn by the recipient 104, may alternatively be used as a hair extension to add length and volume to the recipient's own hair. In an embodiment, the hair extensions 106 and the anchoring structure 102 are coupled together in a substantially perpendicular manner, which might for convenience be thought of as being in a vertical and horizontal manner.

The hair extensions 106 are made up of a plurality of strands of hair or hair-like fibrous material that are arranged side by side (adjacent to each other) in order to form a linear arrangement which may have the appearance of a row of hair. The weft hair extension 106 is a particular embodiment, which is shown and described as an example, but without limitation as to the possible configurations of hair extensions which might be employed. Typically, multiple extensions are attached to the recipient's own hair to give the natural appearance of longer or fuller hair, with the lowermost extension being attached near the nape of the neck.

The weft hair extensions 106 may vary with regards to their length, thickness and luster. Nevertheless, once attached, the hair extensions 106 remain securely attached to the anchoring structure 102. The hair extensions 106 so attached can be worn all day and all night and when engaging in strenuous activities such as running or swimming. When the need arises, however, hair extensions 106 attached using the fasteners described herein can be easily removed without damaging the naturally growing hair making up the anchoring structures.

In one embodiment, after the hair extensions 106 are secured to the anchoring structure 102, hair growth causes the distance between the hair extension 106 and the scalp to increase. As the hair grows, additional fastening agents can be employed to bring the hair extension closer to the scalp, maintaining the semblance of naturally growing hair.

As depicted in FIG. 1, the hair extension integration system comprises a hand held device or tool 100 and a weft hair extension. In an embodiment, the hand held tool 100 may resemble a suture stapler. The terms "hand held device," "tool," and "stapler," and the like, will be used herein interchangeably, but without limitation as to other possible embodiments thereof. It should be understood that the device 100 does not cause the fastener to have direct contact with the scalp, as might be the case with a conventional device such as a surgical stapler. Rather, embodiments of the present device prevent such contact, for instance, by using a safety shield, or a spacer which maintains a predetermined distance between the fastener and the recipient's scalp. The predetermined distance may be a fixed distance, or may be adjustable.

The present apparatus further includes a user-manipulable hand member 108. As the hand member 108 is manipulated, for instance by squeezing, the movable safety shield is moved into place, and the fastener is crimped around the hair extension and the anchoring structure. More specifically, the squeezing causes the shield mechanism to move from the first position to the second position. For instance, the stylist 101 may manipulate the user-manipulable hand member 108 by squeezing it, to move it from the first position (such as a spring-loaded quiescent position) to the second position where the safety shields move towards each other to form a protective barrier between the recipient's scalp and the fastener as a fastener is crimped. The stylist then releases the user manipulable hand member 108, causing the shield mechanism to return to the initial position, for instance, by allowing the spring-loading to return the user-manipulable hand member 108 to its quiescent position.

An alternative embodiment may include, as an alternative to squeezing, a collar mechanism which the stylist moves from an initial position along the user manipulable hand member 108 so as to cause it to vary its angle relative to the tool 100, in effect causing the safety shields to move into position. When the collar mechanism is slid back to its initial position, the safety shields move back, as well, for instance under the influence of the spring-loading. The collar may also be used as a lock, to hold the tool 100 in a closed position for storage.

Figure 2:
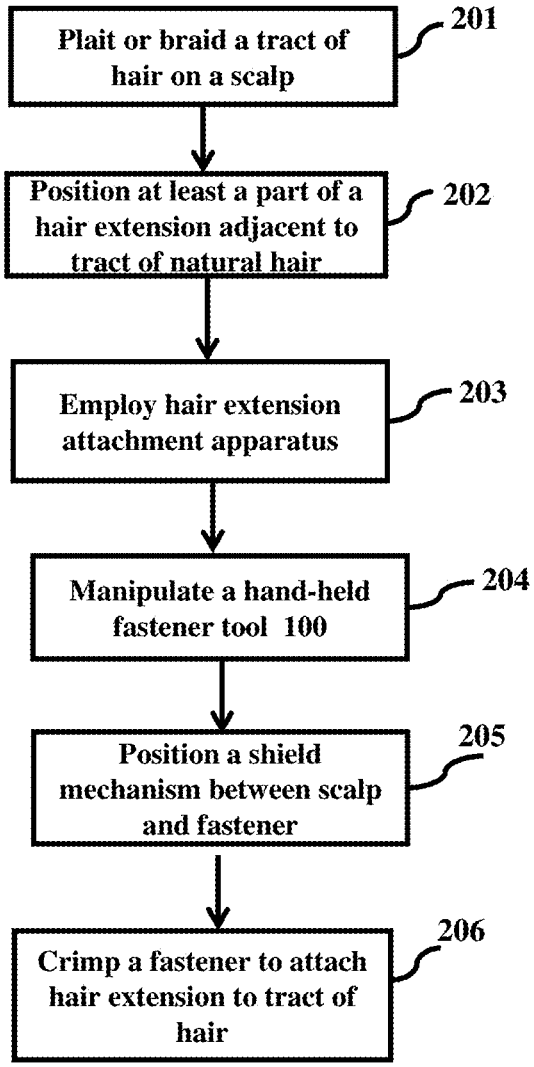
FIG. 2 is a flowchart depicting the process of attaching hair extensions using a hand held device, according to the embodiments as disclosed herein.

FIG. 2 is a flowchart depicting the process of attaching hair extensions using a hand held device, according to the embodiments as disclosed herein. In an embodiment, the method for integrating hair extensions involves using the hand held device 100 to attach the weft hair extension 106 directly on a tract of natural hair making up the anchoring structure 102. A fastener such as a staple is crimped around the hair extension 106 and the anchoring structure 102 to form a secure bond between them. The fastener used does not penetrate the scalp due to a barrier provided by a shield mechanism, herein also referred to as safety feet (as depicted in several of the drawings to be discussed below).

FIG. 2 is a flow diagram depicting the complete method embodying the present subject matter to attach hair extensions to human hair, according to the embodiments as disclosed herein.

At step 201, an anchoring structure is defined. "Anchoring structure" refers to something to which a hair extension will be attached. "Anchoring structure" may refer to a braid, cornrow, or other configuration of natural existing hair already present on the recipient's scalp, skin, etc. Alternatively, an anchoring structure may be a wig cap, mesh, or other suitable appliance worn on the recipient's head. The appliance can be used in conjunction with the braid, cornrow, etc. For instance, a fastener can be crimped so as to hold both the braid, cornrow, etc., and also an appliance placed on the recipient's head over the braid, cornrow, etc. Such an appliance should be reasonably secure on the recipient's head, etc., so as to provide a secure anchoring support for the hair extension to be attached.

The term "defined" or "defining" is broadly intended either to mean creating an anchoring structure, such as by braiding the hair naturally present or adding an appliance such as the aforementioned wig cap or mesh, etc.; or to cover identifying an anchoring structure, such as a hair braid that is already present.

In the embodiment of FIG. 2, for instance, a tract of hair is plaited or braided on the scalp. Doing so produces the anchoring structure 102, to which the hair extension 106 will be attached. In one embodiment of such an anchoring structure 102, the tract of hair might be braided into a cornrow as shown in FIG. 1. Accordingly, as the braid proceeds along the scalp region from one end to the other, the successive hairs are woven into the braid near their roots, anchoring the cornrow right along the scalp. The anchoring structure 102 provides sufficient support for the hair extension 106 to be attached, so that the weight of the hair extension 106, and the tension on the hair extension 106 caused by activities such as brushing or combing the hair extension 106, does not easily detach the hair extension 106, and does not pull out natural hair by the roots.

In an embodiment, the size of the cornrow and the depth of the safety shield of the hand held device are chosen for suitable compatibility with each other. For instance, a standard size cornrow might be approximately 35 mm wide.

At step 202, at least a part of the hair extension 106 is positioned adjacent to the tract of natural hair making up the anchoring structure 102. In an embodiment, the hair extension 106 is positioned adjacent to the anchoring structure 102 such as the cornrow. Attached in this manner, the hair extension will give the semblance of emerging from the scalp itself, thus creating the appearance of naturally growing hair.

At step 203, the hair stylist 101 positions the hair extension attachment device 100 along the anchoring structure 102 at the point where the hair extension 106 is to be attached. The orientation of the anchoring structure 102, the hair extension 106, and the device 100, relative to each other, may be chosen according to the judgment and experience of the hair stylist 101.

In an embodiment, the handle members of the device 100 may be biased, such as by spring-loading, into a quiescent position which is overcome as the stylist 101 squeezes the handle members (step 204). As the handle members are manipulated thusly, two mechanical activities take place, in a predetermined sequence related to the degree to which the handles are squeezed.

First, the safety shields 302 are moved from the quiescent position of their own, into a position which shields the recipient 104's scalp from the fastener (step 205).

Second, a fastener is then crimped to be attached to the hair extension 106 and cornrow 102 (step 206).

After the hair extension attachment apparatus 100 of the present subject matter is employed, the stylist 101 releases the handle 108 of the device 100, and the handle 108 returns to its quiescent state, for instance, by the agency of the spring-loaded biasing. Then, the safety shields 302 return to their open position, and the stylist 101 may freely move the hand held device 100 to another position to complete additional points of attachment for hair extension 106.

The various actions in method of FIG. 2 may be performed in the order presented, in a different order or simultaneously. Further, in some embodiments, some actions listed in FIG. 2 may be omitted.

Figure 3:
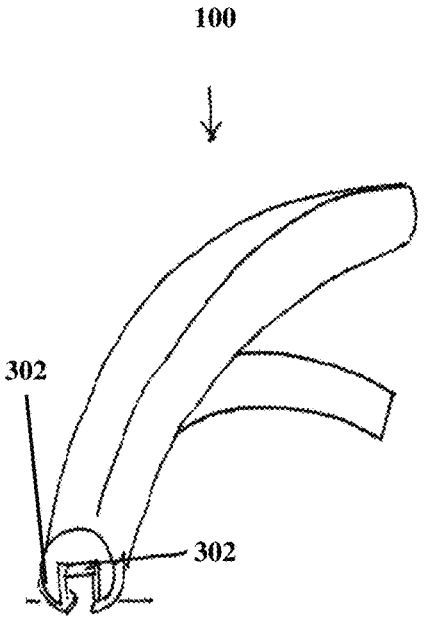
FIG. 3 is a detailed section view of a hand held device for attaching hair extensions, according to the embodiments as disclosed herein.

FIG. 3 is a section view depicting the hand held tool 100, which is also referred to herein as a "hand held device," or "fastening device," and is equivalent to the tool 100 of FIG. 1, including a shield mechanism of the fastening device, according to the embodiments as disclosed herein. The first (open) position of the device is configured to at least partially enclose the terminal ends of the fastener.

The fastening device 100 further comprises a nozzle configured to discharge the fastener, typically one fastener at a time. The fastener comprises a U-shaped member having a pair of terminal ends which may be crimped together in conventional fashion, toward the middle portion of the fastener, thereby securing hair extension 106 and anchoring structure 102 together.

The pair of safety feet 302 is actuated to a second (closed) position before the fastener is discharged. In this embodiment, the discharged fastener presses down on the pair of safety feet 302. The pair of terminal ends, which comprise a malleable material, bend inwardly in conformance to the contour of the safety feet 302. The inward bend created by the junction in the pair of safety feet 302 forms a crimp on the fastener that at least partially encloses the tract of natural hair making up the anchoring structure 102 and the weft hair extension 106.

In an embodiment, the safety feet 302 move inward, toward each other, in correspondence with user manipulation of the handle of the tool 100. For instance, the handle might be spring-loaded to a mechanically biased quiescent, open position in which the safety feet 302 are retracted. The spring loading may be provided by a suitable spring member, such as a torsion spring or a flex arm (not shown). The stylist squeezes the handle, effectively converting handle manipulation into corresponding rotational movement of the safety feet 302. Finally, the pair of safety feet 302 is actuated to an open position to release the device 100 for the next hair integration. The pair of safety feet 302 disengages from around the hair tract of natural hair making up the anchoring structure 102 and weft hair extension 106, leaving the fastener securely attached to both sets of hair. Thus, after the stylist attaches a hair extension to the recipient's hair, releasing the handle causes the spring-loading to return the handle to the quiescent position, and correspondingly to cause the cam or other structure to rotate the safety feet back to their retracted, quiescent positions.

Different embodiments of the present subject matter may implement crimping of the fastener, and movement of the safety feet 302, as a function of rotational movement of the handle 108 of the tool 100. In one embodiment, as the handle 108 is gradually squeezed inward relative to the tool 100, the safety feet 302 first move into position, and then the fastener is crimped. Thus, the safety feet 302 are already in position, as the fastener is crimped, so that the recipient's scalp is protected from the fastener. In another embodiment, the movement of the safety feet 302 and the crimping of the fastener can take place simultaneously, that is, both happening as the handle 108 passes through the same angular rotation caused by the squeezing. It may be the case that, in such an embodiment, the safety feet 302 are sufficiently in position that the recipient's scalp is protected from injury from the fastener, even as the fastener is being crimped. In addition to these two embodiments, other embodiments, within the spirit and scope of the present subject matter, may implement the squeezing of the handle 108, and the movement of the safety feet 302 and the crimping of the fastener, in any sequence, or simultaneity, which may be suitable to meet the needs of stylists and hair extension recipients.

Figure 4:
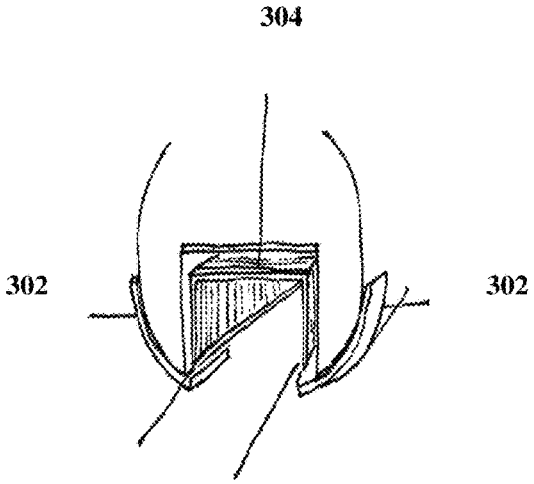
FIG. 4 is a close-up section view of the hand held device of FIG. 3, showing the shield mechanism of the hand held apparatus, according to the embodiments as disclosed herein.

FIG. 4 is a close-up section view of the front portion of the hand held tool of FIG. 3, showing further details of the implementation of the present embodiment. The tool 100 comprises safety shields 302, herein also referred to as safety feet, that slide from an open position (as shown in FIG. 4) to a closed position. The open position of FIG. 4 is configured to gather and release the tract of natural hair making up the anchoring structure 102. Fasteners 304 are here shown as staples.

Figure 5:
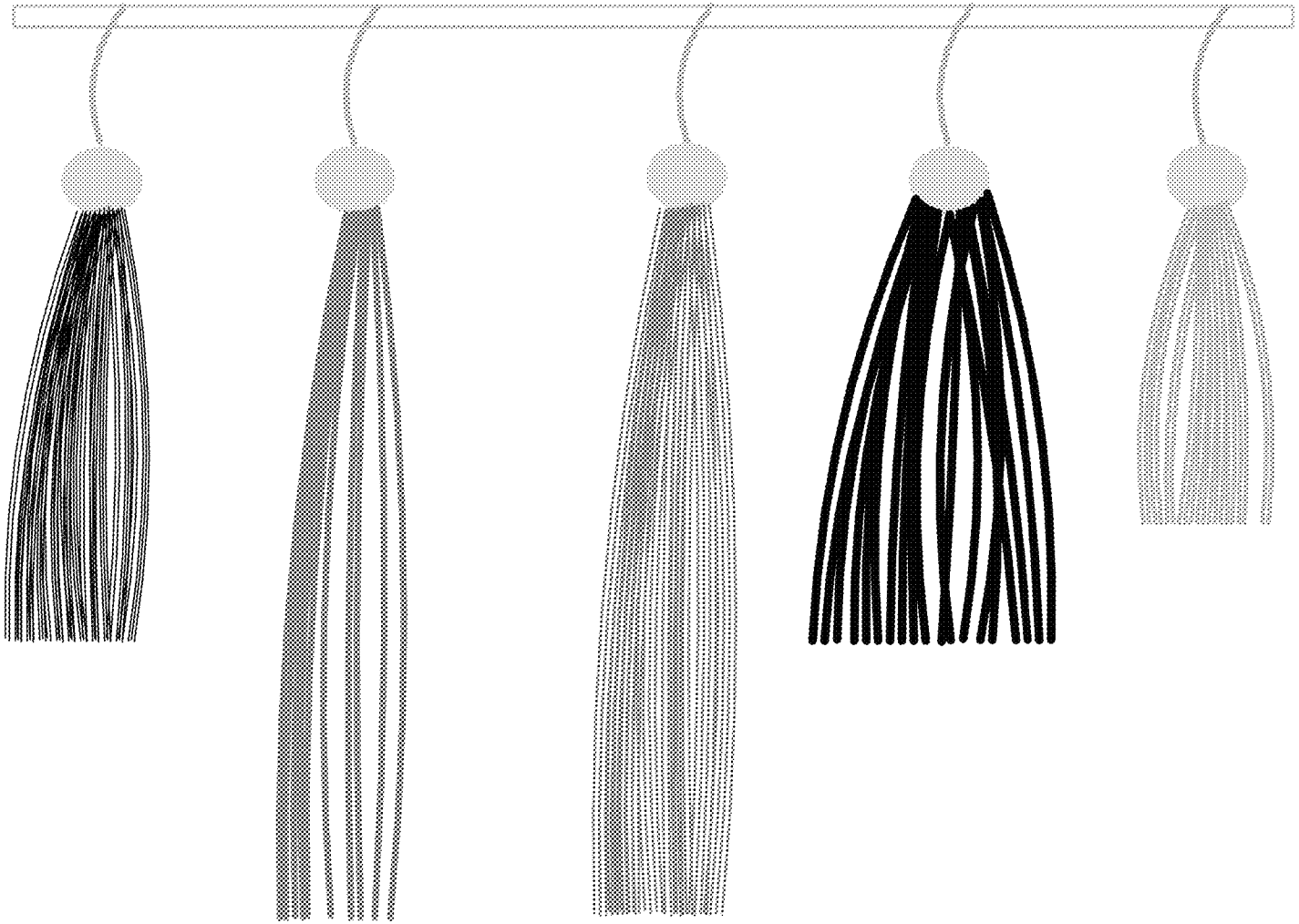
FIG. 5 illustrates various different types of hair extensions, according to the embodiments as disclosed herein.

FIG. 5 illustrates a rack of hangers bearing hair extensions. Hair extensions have different colors, styles, and lengths, according to the embodiments as disclosed herein. As shown, natural hair extensions, obtained from hair donors, and artificial-fiber hair extensions can vary in texture, color and sheen. Hair extensions can be aggregations of individual hairs assembled into a weft, or can be pre-braided.

FIGS. 6A, 6B, 6C, and 6D show a sequence of close-up views of the head of the hand held tool 100 of FIGS. 3 and 4, showing stages during the operation of the tool 100 to attach a hair extension to the anchoring structure on the scalp of the hair extension recipient.

FIG. 6A shows an initial position of the head of the tool 100, before the stylist begins to manipulate the handle to attach the hair extension. As shown, the safety shields 302 are in an initial, retracted position, in which there is open space for positioning the head of the tool 100 over the anchoring structure, with a hair extension positioned adjacent to the anchoring structure, in preparation for attaching. The initial, retracted position of the safety shields 302 may be a quiescent position, in which the spring-loaded handle biases the handle to its initial position, and the tool 100 has not yet been manipulated by the stylist. For convenience, it may be said, without limitation, that the initial, quiescent position of the safety shields 302 is an open position, and that user manipulation urges the safety shields 302 toward a closed position.

FIG. 6B shows a position in which the user has begun to manipulate the handle of the tool 100 to attach the hair extension to the anchoring structure. According to the convention mentioned just above, it may be said that the safety shields 302 are being manipulated from the initial open position, toward a closed position, and are now in a semi-closed position. As shown, the fastener has not yet been crimped to do the actual attaching, but the safety shields 302 have rotated from the quiescent positions closer together. As such, they enclose the anchoring structure and the hair extension 106. In an embodiment, the tool 100 might be implemented such that, as the stylist partially manipulates the handle, a structure such as a cam rotates the safety shields into this position before the fastener begins to crimp.

FIG. 6C shows a position in which the user has continued to manipulate the handle of the tool 100, beyond that of FIG. 6B. In this position, the safety shields 302 have moved even closer together and one fastener is dislodged from the rest. This may be done in conventional fashion, by having a forcing member (not shown) pushing against the middle portion of the fastener to detach it from the strip of fasteners contained in the tool 100. In an embodiment, the fastener might be crimped, in conventional fashion, by forcing the ends against an anvil which has a groove to direct the ends of the fastener to an inwardly crimped configuration. Accordingly, the crimped ends of the fastener take hold of the anchoring portion of the person's hair, as well as the hair extension. As a result, the hair extension is securely bound to the anchoring portion, and will remain attached until the fastener is extracted in order to release the hair extension. Note, also, that because the shields 302 have been moved to a closed or semi-closed position, they protect the recipient's scalp from injury from the ends of the fastener.

Figure 6D:
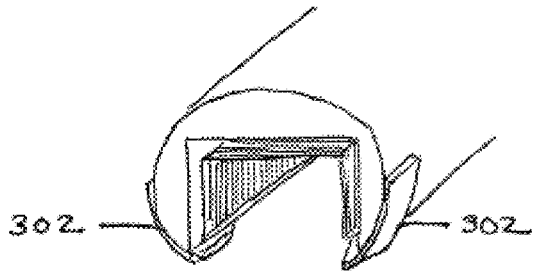

FIG. 6D shows a position, following that of FIG. 6C, in which the stylist has released the handle of the tool 100 and allowed the spring-loaded tool to return to its quiescent position. As shown, the safety shields 302 have moved back to their quiescent position, far enough apart to allow the stylist to move the tool 100 to another part of the recipient's cornrowed hair in preparation for attaching another section of the weft hair extension thereto, if so desired.

FIGS. 7A, 7B and 7C show the operation of a tool 100, such as that of FIGS. 3, 4, and 6A through 6D, showing the person's hair anchoring structure 102 and the hair extension 106 as the tool 100 is used to attach the hair extension. The three illustrated successive stages generally correspond with those of FIGS. 6A, 6B, and 6C respectively.

FIG. 7A depicts an initial stage of the exemplary hair extension in preparation to being attached to the recipient's hair, according to the embodiments as disclosed herein. Before the stylist manipulates the tool 100, the safety shields 302 are in their quiescent, open position. The hair extension 106 has been positioned adjacent to the anchoring structure 102, and the tool 100 is held such that its head, with the fastener dispensing and crimping apparatus, is positioned over the hair extension 106 and the anchoring structure 102.

FIG. 7B depicts a view subsequent to that of FIG. 7A, in which the stylist has begun to manipulate the tool 100, for instance, by squeezing the handle so as to activate the cam to rotate the safety shields 302 beneath the hair extension 106 and the desired area of the anchoring structure 102, where the fastener will be crimped in place.

FIG. 7C depicts a view subsequent to that of FIG. 7B, in which the attachment of the hair extension 106, according to the embodiments as disclosed herein. As shown, the safety shields 302 have moved further into position, and the fastener has been crimped so as to attach the hair extension 106 to the anchoring structure 102. After this, the stylist releases the handle of the tool 100, and the safety shields 302 return to their spring-loaded quiescent position, comparable to that of FIG. 7A. In some embodiments, if the weft hair extension 106 is exceptionally heavy, the process may be repeated in the same area, utilizing additional fasteners for increased security.

In the discussion which follows, several embodiments of the hand held device 100, described above, will be described in further detail. In the drawings, the embodiments are shown in side and front views, along with detailed illustrations of the fastener and shield mechanisms.

Figures 1, 8A:
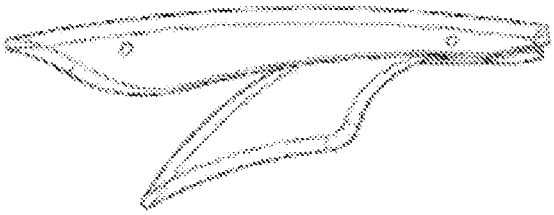
Figures 2, 8A:
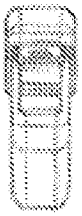
Figures 3, 8A:
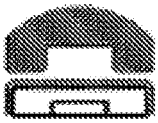
Figures 1, 8B:
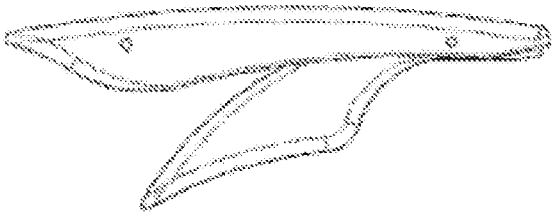
Figures 2, 8B:
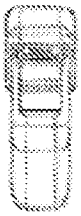
Figures 3, 8B:
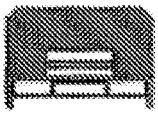
Figures 1, 8C:
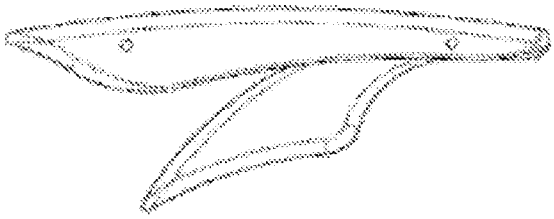
Figures 2, 8C:
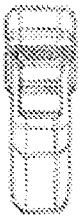
Figures 3, 8C:
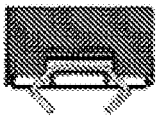
Figures 1, 8D:
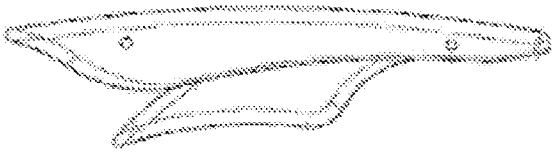
Figures 2, 8D:
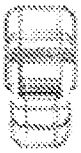
Figures 3, 8D:
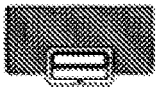
Figures 1, 9A:
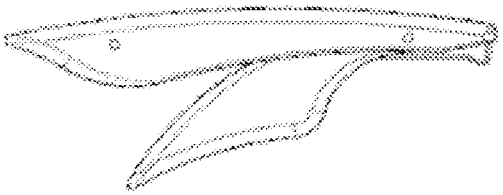
Figures 2, 9A:
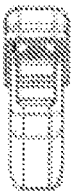
Figures 3, 9A:
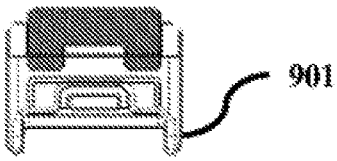
Figures 1, 9B:
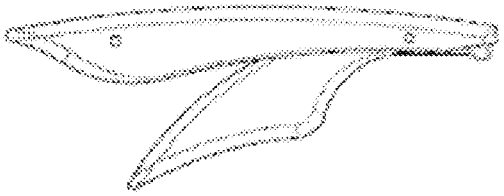
Figures 2, 9B:
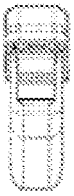
Figures 3, 9B:
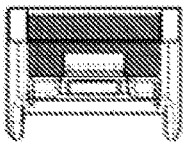
Figures 1, 9C:
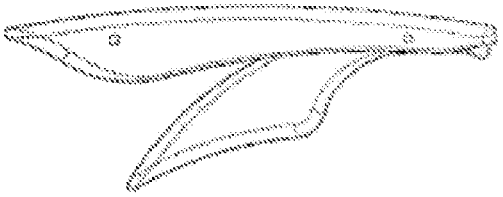
Figures 2, 9C:
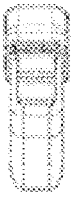
Figures 3, 9C:
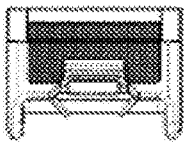
Figures 1, 9D:
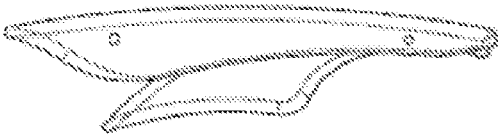
Figures 2, 9D:
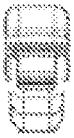
Figures 3, 9D:
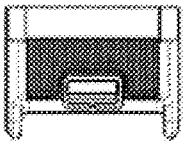
Figures 1, 10A:
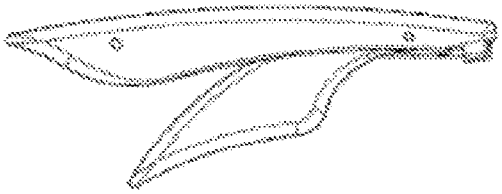
Figures 2, 10A:
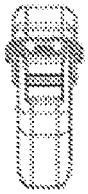
Figures 3, 10A:
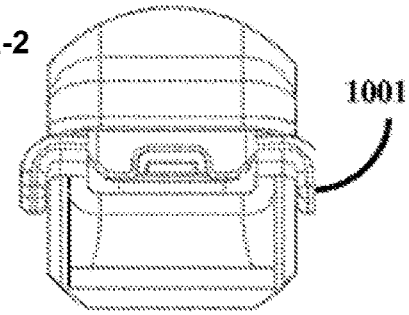
Figures 1, 10B:
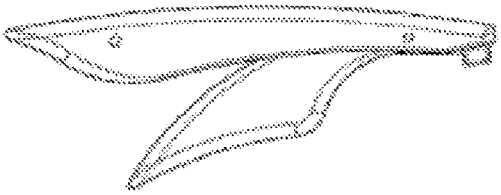
Figures 2, 10B:
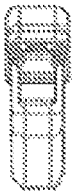
Figures 3, 10B:
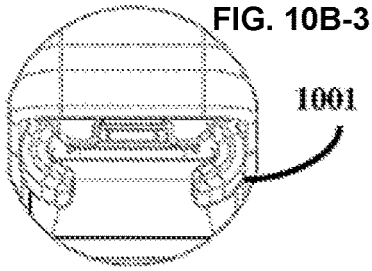
Figures 1, 10C:
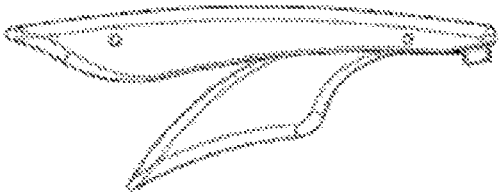
Figures 2, 10C:
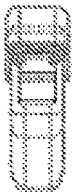
Figures 3, 10C:
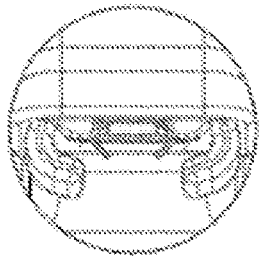
Figures 1, 10D:
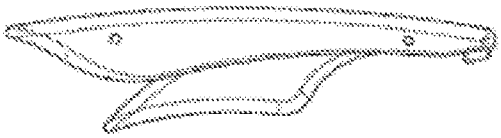
Figures 2, 10D:
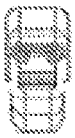
Figures 3, 10D:
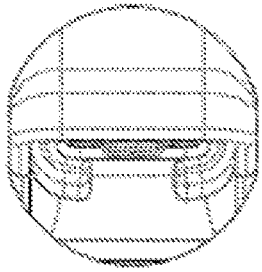

FIGS. 8A-1, 8A-2, 8A-3, 8B-1, 8B-2, 8B-3, 8C-1, 8C-2, 8C-3, 8D-1, 8D-2, and 8D-3 show views of a hand held device such as the device 100 described above. There are three views for each stage of operation, including a side view (left, FIGS. 8A-1, 8B-1, 8C-1, and 8D-1), a front view (center, FIGS. 8A-2, 8B-2, 8C-2, and 8D-2), and a detailed portion of the front view, showing the fastener as it is being crimped (right, FIGS. 8A-3, 8B-3, 8C-3, and 8D-3). As shown in the side views FIGS. 8A-1, 8B-1, 8C-1, and 8D-1, the handheld device has two members which may be squeezed'together as the stylist grips it. For illustrative purposes with reference to these drawings, the two members may conveniently be considered, without limitation, as upper and lower members. In particular, FIGS. 8D-1, 8D-2, and 8D-3 show the fully-squeezed configuration, in which the lower member is positioned closest to the upper member due to the stylist's squeezing. Likewise, the front view of in FIG. 8D-2 shows the lower member retracted within the upper member. In the detailed views FIGS. 8A-3, 8B-3, 8C-3, and 8D-3, an alternative method for crimping the fastener is shown. FIGS. 8A-1, 8A-2, and 8A-3 illustrate a first stage of operation, which is the starting condition. FIGS. 8B-1, 8B-2, and 8B-3 illustrate a second stage of operation, in which the handle is partially squeezed. FIGS. 8C-1, 8C-2, and 8C-3 illustrate a third stage of operation, in which the handle is further partially squeezed. FIGS. 8D-1, 8D-2, and 8D-3 illustrate a fourth stage of operation, in which the handle is fully squeezed.

In this embodiment, the anvil that crimps the fastener is a moveable element contained in the hand held device 100. The anvil shapes the fastener by pressing down on the fastener from above as it dislodges a single fastener from a row of fasteners. The fastener's crimped shape is determined by this action, and results in the crimped fastener having four points of inflection.

FIGS. 9A-1, 9A-2, 9A-3, 9B-1, 9B-2, 9B-3, 9C-1, 9C-2, 9C-3, 9D-1, 9D-2, and 9D-3 show views, similar to those of FIGS. 8A-1 through 8D-3, of an embodiment in which the recipient's scalp is protected from injury from the fasteners by means of fixed-position members, such as spacers 901, that maintain a predetermined distance between the fastener and the recipient's scalp. As shown, particularly in FIGS. 9C-1 through 9D-3, the fasteners are held at a specific height by the spacers 901, so that they are crimped without touching the recipient's scalp. FIGS. 9A-1, 9A-2, and 9A-3 illustrate a first stage of operation, which is the starting condition. FIGS. 9B-1, 9B-2, and 9B-3 illustrate a second stage of operation, in which the handle is partially squeezed. FIGS. 9C-1, 9C-2, and 9C-3 illustrate a third stage of operation, in which the handle is further partially squeezed. FIGS. 9D-1, 9D-2, and 9D-3 illustrate a fourth stage of operation, in which the handle is fully squeezed.

FIGS. 10A-1, 10A-2, 10A-3, 10B-1, 10B-2, 10B-3, 10C-1, 10C-2, 10C-3, 10D-1, 10D-2, and 10D-3 show views, again similar to those of FIGS. 8A through 8D and 9A through 9D 8A-1 through 8D-3 and 9A-1 through 9D-3, of an embodiment in which the recipient's scalp is protected from injury from the fasteners by means of movable members, such as safety shields here shown as 1001, that intervene between the fastener and the recipient's scalp as the fastener is crimped. As shown, particularly in FIGS. 10C-1 through 10D-3, as the fastener is being crimped, the safety shields 1001 move into position between the fastener and the recipient's skin. Movement of the safety shields as well as the crimping of the fastener is driven by the squeezing of the upper and lower members of the device 100 by the stylist. Thus, the safety shields can be moved into position to protect the recipient's scalp before the fastener is crimped. FIGS. 10A-1, 10A-2, and 10A-3 illustrate a first stage of operation, which is the starting condition. FIGS. 10B-1, 10B-2, and 10B-3 illustrate a second stage of operation, in which the handle is partially squeezed. FIGS. 10C-1, 10C-2, and 10C-3 illustrate a third stage of operation, in which the handle is further partially squeezed. FIGS. 10D-1, 10D-2, and 10D-3 illustrate a fourth stage of operation, in which the handle is fully squeezed.

As will be understood by those familiar with the art, the invention may be embodied in other specific forms without departing from the spirit or essential characteristics thereof. Likewise, the particular naming and division of the portions, modules, agents, managers, components, functions, procedures, actions, layers, features, attributes, methodologies and other aspects are not mandatory or significant, and the mechanisms that implement the invention or its features may have different names, divisions and/or formats.

Accordingly, the disclosure of the present invention is intended to be illustrative, but not limiting, of the scope of the invention, which is set forth in the following claims.

What is claimed is:

1. A method for attaching a hair extension to a recipient's hair without injuring the recipient's scalp, the method comprising:

forming a cornrow of the recipient's hair as an anchoring structure for receiving attachment of the hair extension;

positioning the hair extension adjacent to the anchoring structure;

employing a hair extension attachment apparatus to attach the hair extension to the anchoring structure; wherein the employment includes:

manipulating a user manipulable hand member of the apparatus to crimp a fastener to attach the hair extension to the anchoring structure and position a shield mechanism between the recipient's scalp and the anchoring structure as the fastener is being crimped;

wherein the shield mechanism includes a movable safety shield disposed on the user manipulable hand member of the hair extension attachment apparatus so as to move from a first position to a second position between the recipient's scalp and the anchoring structure, as the fastener is crimped.

2. A method as recited in claim 1, wherein:

the fastener is a staple.

3. A method as recited in claim 1, wherein the shield mechanism includes a spacer disposed on the user manipulable hand member of the hair extension attachment apparatus so as to maintain a predetermined distance between the recipient's scalp and the fastener, as the fastener is crimped.

4. A method as recited in claim 1 wherein positioning the shield mechanism occurs before crimping the fastener.

5. A method as recited in claim 1 wherein positioning the shield mechanism occurs while crimping the fastener.

6. A method as recited in claim 1 wherein:

crimping the fastener to attach the hair extension to the anchoring structure includes crimping the fastener around both the hair extension and the anchoring structure.

* * * * *